US007860435B2

(12) United States Patent
Aimoto

(10) Patent No.: US 7,860,435 B2
(45) Date of Patent: Dec. 28, 2010

(54) DEVELOPING DEVICE

(75) Inventor: Toyoka Aimoto, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 821 days.

(21) Appl. No.: 11/812,454

(22) Filed: Jun. 19, 2007

(65) Prior Publication Data

US 2008/0124132 A1 May 29, 2008

(30) Foreign Application Priority Data

Jun. 20, 2006 (JP) ..... P2006-170725

(51) Int. Cl.
*G03G 15/08* (2006.01)

(52) U.S. Cl. ..... 399/255; 399/256

(58) Field of Classification Search ..... 399/254–259, 399/264

See application file for complete search history.

(56) References Cited

U.S. PATENT DOCUMENTS 5,950,056 A 9/1999 Hamamichi et al.
6,587,661 B1 * 7/2003 Shimmura et al. ..... 399/257

FOREIGN PATENT DOCUMENTS

| | | | |
|---|---|---|---|
| JP | 58121070 A | * | 7/1983 |
| JP | 11-133710 | | 5/1999 |
| JP | 11-174800 | | 7/1999 |
| JP | 2005091914 A | * | 4/2005 |
| JP | 2005-134431 | | 5/2005 |

* cited by examiner

*Primary Examiner*—David M Gray
*Assistant Examiner*—Gregory H Curran
(74) *Attorney, Agent, or Firm*—Nixon & Vanderhye, PC

(57) ABSTRACT

A developing device includes a developing tank having a developing region tank and an agitating region tank, a partition wall member, a first agitating and conveying member, a second agitating and conveying member, a first intermediate wall member, a second intermediate wall member and a sensor, and an opening portion is formed. In the developing device, a third agitating and conveying member extending in a longitudinal direction of the agitating region tank is provided between the second agitating and conveying member and the second intermediate wall member in a transverse direction of the agitating region tank.

19 Claims, 9 Drawing Sheets

DEVELOPING DEVICE

CROSS-REFERENCE TO RELATED APPLICATION

This application claims priority to Japanese Patent Application No. 2006-170725, which was filed on Jun. 20, 2006, the contents of which are incorporated herein by reference in their entirety.

BACKGROUND OF THE TECHNOLOGY

1. Field of the Technology

The present technology relates to a developing device.

2. Description of the Related Art

In an electrophotographic image forming apparatus, for example, a toner contained in a two-component developer (hereinafter simply referred to as a "developer") is supplied from a developing device to an electrostatic latent image on a surface of a photoreceptor, thereby a toner image is formed, and the toner image is further transferred and fixed on a record medium, thereby an image is formed. A toner supply from the developing device to the electrostatic latent image is carried out via a developer bearing member from a developing tank which is a container for housing the toner therein. The electrophotographic image forming apparatus is in heavy usage for a copy machine, a printer, a facsimile apparatus, or the like, and is widely spread because high quality images can be formed by easy operation, and maintenance management is facilitated. According to this, further improvement of performance of the electrophotographic image forming apparatus is required. Among them, it is especially important to increase the image forming speed and increase a number of images formed in unit time. There are various kinds of problems with respect to the high image forming speed, for example, prolongation of a life of a carrier contained in the developer. The developer contains a toner and a carrier. The carrier has a function to charge the toner by being agitated and rubbed with the toner in the developing device. A high quality image can be formed by appropriately charging the toner. Further, in general, the toner is sequentially replenished in response to a situation of toner consumption on one hand, the carrier is used until the durable life of the carrier is finished on the other hand. A toner consumption amount is increased under a high image forming speed, so that the carrier is always exposed to rubbing contact with the toner, thereby physical and mechanical stress applied to the carrier are extremely large. As a result, deterioration of the carrier is progressed, so that a uniform charge amount cannot be applied to the toner, causing the charging defect of the toner, thereby the image density of the formed image is instable. Also, the durable life of the carrier is finished within a short term, thereby causing the problem that frequency of the maintenance management to exchange the carrier is increased.

In order to solve such problems, for example, a measure may be adopted in which the size of the developing device is enlarged so as to increase the housed amount of the carrier. This is to lower the frequency at which the carrier is exposed to the stress by the agitation when the image is formed at high speed by housing more carrier in the developing device, so that the usable life of the carrier is intended to be prolonged. However, due to a structural limitation of the image forming apparatus, the size of the developing device cannot be enlarged to a degree corresponding to the high image forming speed in many cases. Also, improvement of the developing tank is attempted. In a longitudinal direction of the developing device, it is general to dispose the developing tank and the developer bearing member, which are formed to have almost same longitudinal dimensions, in parallel with each other. In the technical improvement, a constitution is adopted in which one end portion of the developing tank is extended, a part of the developing tank facing the developer bearing member is made to be a developing region, an extended part is made to be an agitating region, and the developing region and the agitating region are separated from each other by a partition wall member. In an inner space of the developing tank, two screw members, which are agitating and conveying members, are provided in parallel with each other in a longitudinal direction of the developing tank with penetrating the partition wall member, and the toner is replenished into the agitating region through a toner replenishing port formed on the developing tank wall of the agitating region. In the developing tank, by rotations of the screw members, after the newly replenished toner is mixed with the developer in the agitating region, the developer is conveyed from the agitating region toward the developing region in the longitudinal direction of the developing tank. Further, after the developer is in contact with the developer bearing member in the developing region, the developer is conveyed from the developing region toward the agitating region in the longitudinal direction of the developing tank. That is, a conveying path is formed, where the developer, in which the toner and the carrier are uniformly mixed with each other, is conveyed back and forth in the longitudinal direction of the developing tank. By conveying the developer in the longitudinal direction of the developing tank, even in a case where the toner consumption amount is large under the high image forming speed, the toner is rubbed with the carrier over a relatively long distance, so that the sufficient charge is applied to the toner. The physical stress, the mechanical stress, or the like, applied to the carrier is also reduced, so that an exchange period of the carrier can be prolonged. However, even in such a constitution of the developing tank, the toner density tends to be non-uniform in the longitudinal direction of the developing tank, so that there is a fear that the image density of the formed image is lowered.

Also, in order to prevent the charging defect of the toner by the deterioration of the carrier, the trickle system developing tank is suggested. In the trickle system, the toner and the carrier are replenished in the developing tank, and the redundant developer is discharged from the developing tank. Thereby, the deteriorated carrier is gradually exchanged with the new carrier, so that a possibility that the charging defect of the toner is caused is low, even when an operation causing a large stress such as the image forming at high speed is carried out. However, under the conventional trickle system, it is difficult to discharge the developer quantitatively and stably outside the developing tank, so that the amount of the developer in the developing tank is varied, thereby there is the fear that the charging defect of the toner, a temporal inadequacy of the toner amount, or the like, is caused.

On the other hand, a developing device in which three screw members are disposed in parallel with each other in the longitudinal direction of the developing tank is suggested (see Japanese Unexamined Patent Publication JP-A 11-133710 (1999), for example). In the developing device according to JP-A 11-133710, two screw members are disposed near a developing roller such that their developer conveying directions are the same as that of each other, further another screw member is disposed below them in a vertical direction. In the developing device, no partition wall member is provided in the developing tank. By the constitution simply disposing the three screw members, in a case where the image forming speed is set at high, it is difficult to uniformly mix the toner supplied to the developing tank and the developer already existing in the developing tank, so that the inadequacy of the toner density, the charging defect of the toner, or the like, tends to be caused.

SUMMARY OF THE TECHNOLOGY

An object of the technology is to provide a developing device having a developing tank which stores a developer therein, wherein an amount of the developer in the developing tank is controlled with high degree of accuracy and stably and poor toner charging, inadequate toner density or the like is extremely prevented.

The technology provides a developing device which is provided in an electrophotographic image forming apparatus to supply a developer to a photoreceptor provided in the image forming apparatus and develop an electrostatic latent image formed on the photoreceptor, comprising:

a developer bearing member disposed rotatably so as to face the photoreceptor, for bearing the developer thereon;

a developing tank for housing the developer therein, a length of the developing tank being beyond a length in an axial direction of the developer bearing member, the developing tank being replenished with a mixture of toner and carrier, the developing tank including a developing region tank which agitates and conveys the developer and supplies the developer to the developer bearing member, and an agitating region tank which is disposed in connection with the developing region tank and on a position beyond the length of the developer bearing member, agitates and conveys the replenished mixture of toner and carrier with the developer and supplies the mixture therewith to the developing region tank, and receives a part of the developer supplied to the developer bearing member but unconsumed and recovered;

a first agitating and conveying member which is disposed so as to extend from the agitating region tank to the developing region tank, and agitates and conveys the developer in a direction toward the developer bearing member;

a second agitating and conveying member which is disposed so as to extend from the developing region tank to the agitating region tank, supplies the developer to the developer bearing member, and agitates and conveys the developer in a direction away from the developer bearing member;

a third agitating and conveying member which is disposed between the first agitating and conveying member and the second agitating and conveying member in the agitating region tank, and agitates and conveys the developer in the direction away from the developer bearing member; and an opening portion for discharging a predetermined amount of the developer from the developing tank.

In the developing tank including the developing region tank and the agitating region tank, the first agitating and conveying member and the second agitating and conveying member are provided so as to extend through the developing region tank and the agitating region tank, and further, in the agitating region tank, the third agitating and conveying member is provided between the first agitating and conveying member and the second agitating and conveying member, so that a flow of the developer circulating in the developing tank in a longitudinal direction of the developing tank and a flow of the developer circulating in the agitating region tank in the longitudinal direction of the developing tank are caused. Thereby, the developer flows smoothly in constant directions in the developing tank, so that the developer containing a deteriorated carrier can be quantitatively and stably discharged outside the developing tank. That is, although not only the new toner but the mixture of toner and carrier is replenished in the developing tank, a constant amount of the developer is always housed therein, so that the charging defect of the toner, the inadequacy of the toner density, or the like, is hardly caused. Therefore, by using the developing device in the electrophotographic image forming apparatus, high quality images can be stably formed.

It is preferable that the developing tank includes a partition wall member which is disposed so as to separate the developing region tank from the agitating region tank and is formed so that the first agitating and conveying member and the second agitating and conveying member penetrate the partition wall member.

In the developing tank, by disposing the partition wall member which separates the developing region tank from the agitating region tank and has through holes into which the first agitating and conveying member and the second agitating and conveying member are inserted, the flow of the developer within the developing tank is further stabilized, so that the developer is efficiently agitated and the toner can be uniformly charged.

Further, it is preferable that the opening portion is formed in a developing tank wall which is on a downstream side of the developer bearing member in an agitating and conveying direction of the developer by the second agitating and conveying member and faces the second agitating and conveying member.

Further, it is preferable that the opening portion is formed in a developing tank wall of the developing region tank which is on the downstream side of the developer bearing member in the agitating and conveying direction of the developer by the second agitating and conveying member and faces the second agitating and conveying member.

By disposing the opening portion in the developing tank wall which is on the downstream side of the developer bearing member in the agitating and conveying direction of the developer by the second agitating and conveying member and faces the second agitating and conveying member, more preferably, in the developing tank wall of the developing region tank which faces the second agitating and conveying member, the developer which has been removed from the surface of the developer bearing member by the supply of the new developer to the developer bearing member and thus contains the toner in low density and much of the relatively deteriorated carrier, can be almost selectively discharged outside the developing tank, so that the carrier can be effectively exchanged.

Further, it is preferable that the developing tank includes a sensor which is disposed on a developing tank wall and detects an amount of the developer, the developing tank wall being on the upstream side of the developer bearing member in an agitating and conveying direction of the developer by the first agitating and conveying member and facing the first agitating and conveying member.

By disposing the sensor which detects the amount of the developer, on the developing tank wall which is on the upstream side of the developer bearing member in the agitating and conveying direction of the developer by the first agitating and conveying member and faces the first agitating and conveying member, a toner density in the developer at a stage before the developer is supplied to the developer bearing member is detected, so that the toner density can be corrected, for example, by increasing a rotation speed of the first agitating and conveying member, and so on. Therefore, the developer with a proper toner density can be stably supplied to the developer bearing member.

Further, it is preferable that the sensor is a magnetic permeability sensor or a piezoelectric sensor.

As the sensor, preferably a magnetic permeability system sensor or a piezoelectric system sensor, which can accurately detect the toner density in the developer, is used.

Further, it is preferable that the developing tank further includes a developer replenishing port which is formed on a developing tank wall above the second agitating and conveying member and the third agitating and conveying member in the agitating region tank, and receives the mixture of toner and carrier to be replenished.

By forming the developer replenishing port on the developing tank wall above the second agitating and conveying member and the third agitating and conveying member in the agitating region tank and newly supplying the mixture of toner and carrier through the developer replenishing port, after the newly supplied mixture is uniformly mixed with the developer in the agitating region tank within a relatively short time, the mixture is conveyed into the developing region tank, so that the charging defect of the toner, the inadequacy of the toner density, or the like, is further hardly caused.

Further, it is preferable that the developing device further comprises a toner hopper which is disposed so as to be in communication with the developer replenishing port, accepts the mixture of toner and carrier in an inner space thereof, and replenishes the mixture of toner and carrier to the agitating region tank through the developer replenishing port.

The toner hopper which accepts the mixture of toner and carrier in the inner space, can be disposed so as to be in communication with the developer replenishing port. A relatively large lump of the mixture is generally supplied from the toner hopper into the agitating region tank. Even in such case, by a cooperation of the second agitating and conveying member with the third agitating and conveying member as well as the flow of the developer in the agitating region tank, the lump of the mixture is uniformly mixed with the developer in the agitating region tank within a relatively short time.

Further, it is preferable that the first agitating and conveying member, the second agitating and conveying member and the third agitating and conveying member have a same developer conveying ability as that of each other.

By setting the developer conveying ability of the first agitating and conveying member, the second agitating and conveying member and the third agitating and conveying member to be the same as that of each other, a production cost can be reduced by using components of common design for the respective agitating members, such as an agitating blade, a shaft and a bearing.

Further, it is preferable that the first agitating and conveying member, the second agitating and conveying member and the third agitating and conveying member have different developer conveying abilities from each other.

By setting the developer conveying ability of the first agitating and conveying member, the second agitating and conveying member and the third agitating and conveying member to be different from each other, even when a developer having a different flow property is used by changing the kind of the developer housed in the developing tank, optimization can be carried out in response to the flow property of the developer in the developing tank.

BRIEF DESCRIPTION OF THE DRAWINGS

Other and further objects, features, and advantages will be more explicit from the following detailed description taken with reference to the drawings wherein.

DETAILED DESCRIPTION

Figure 1A:
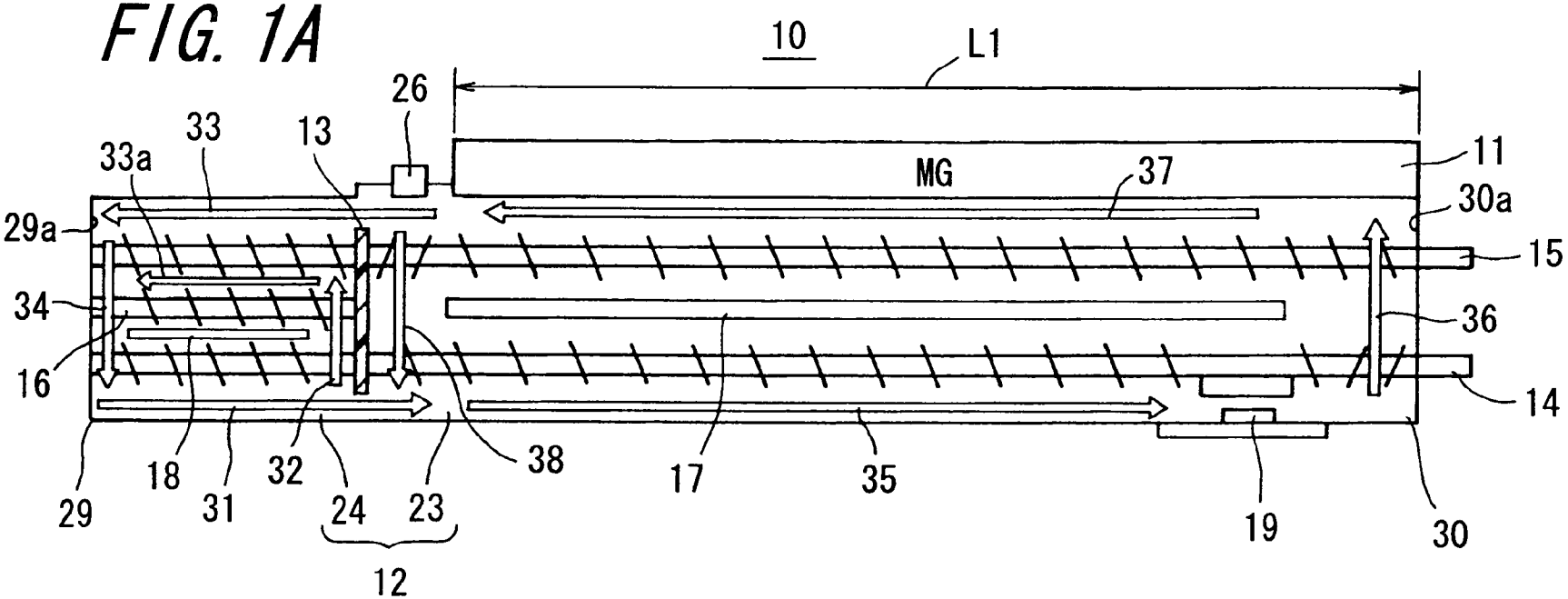
FIGS. 1A and 1B are simplified views showing a constitution of a developing device of one embodiment.

Now referring to the drawings, preferred embodiments are described below.

Figure 1B:
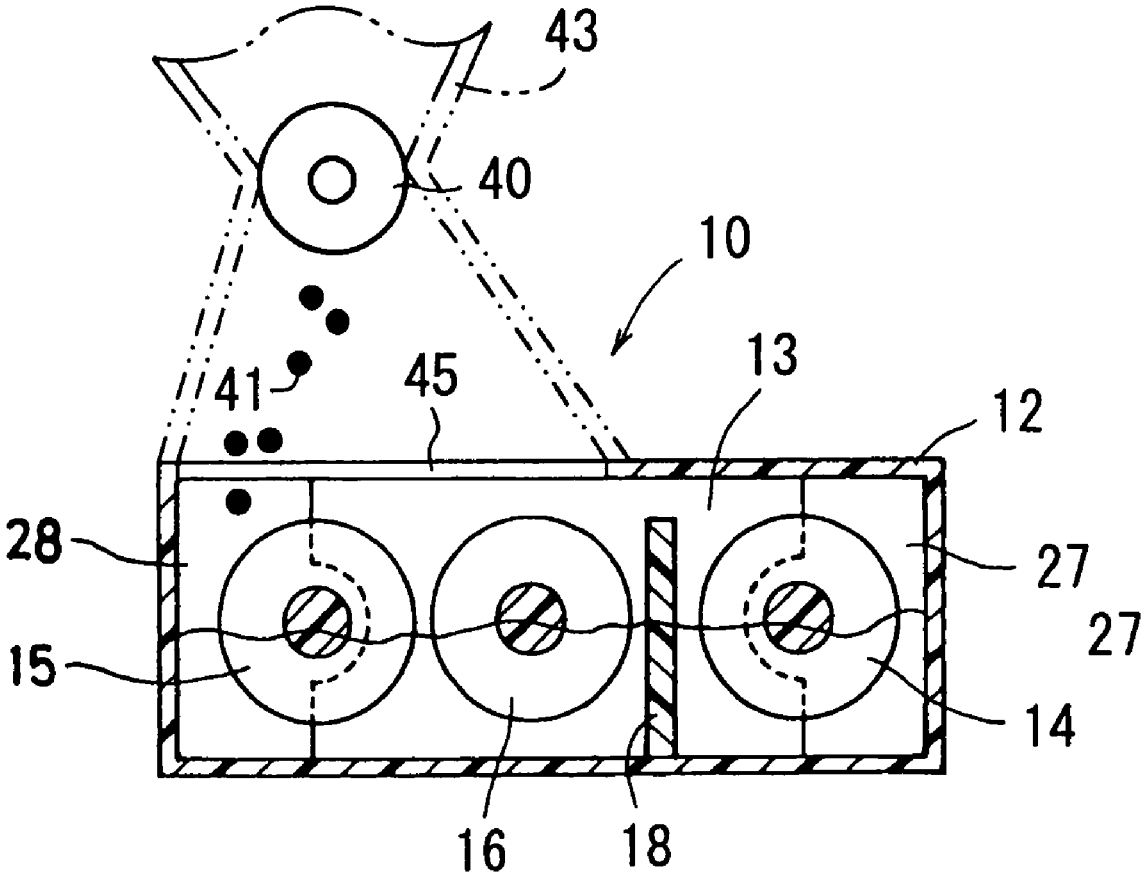
Figure 2:
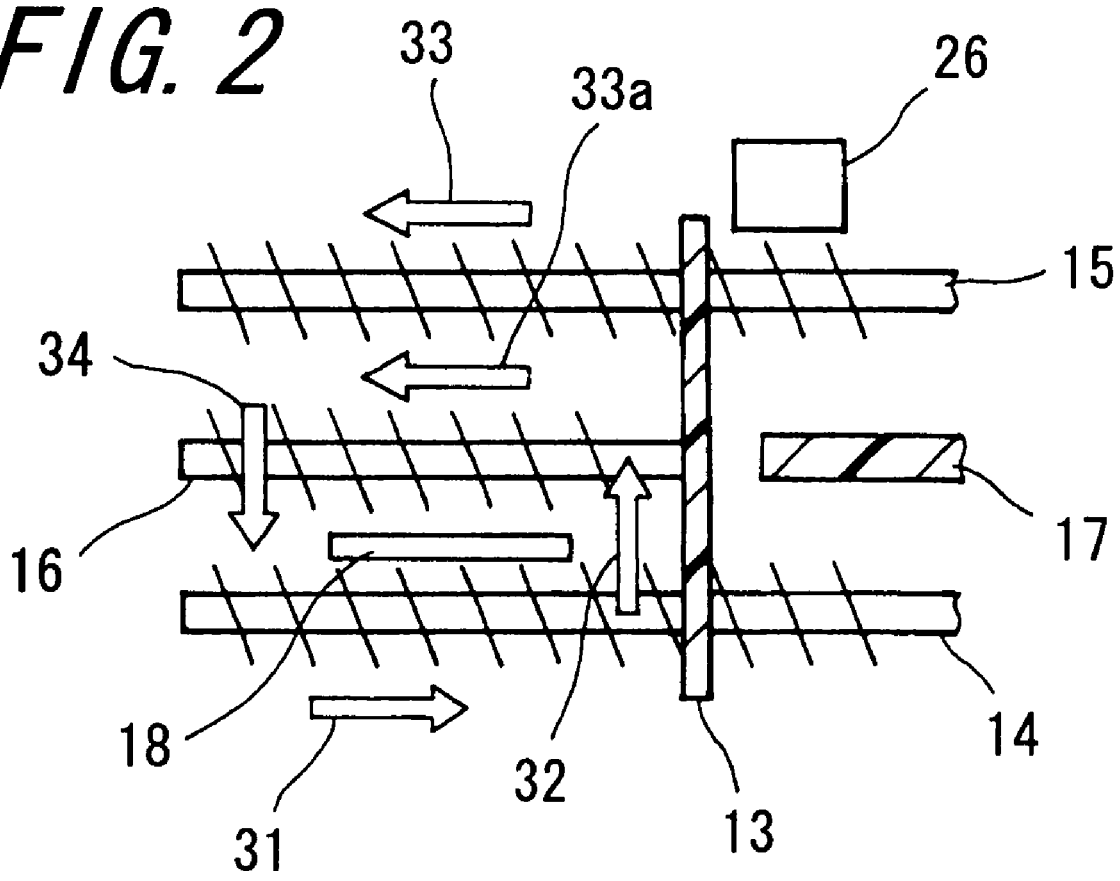
FIG. 2 is an enlarged top view showing a constitution of a main part of the developing device shown in FIGS. 1A and 1B.
Figure 3:
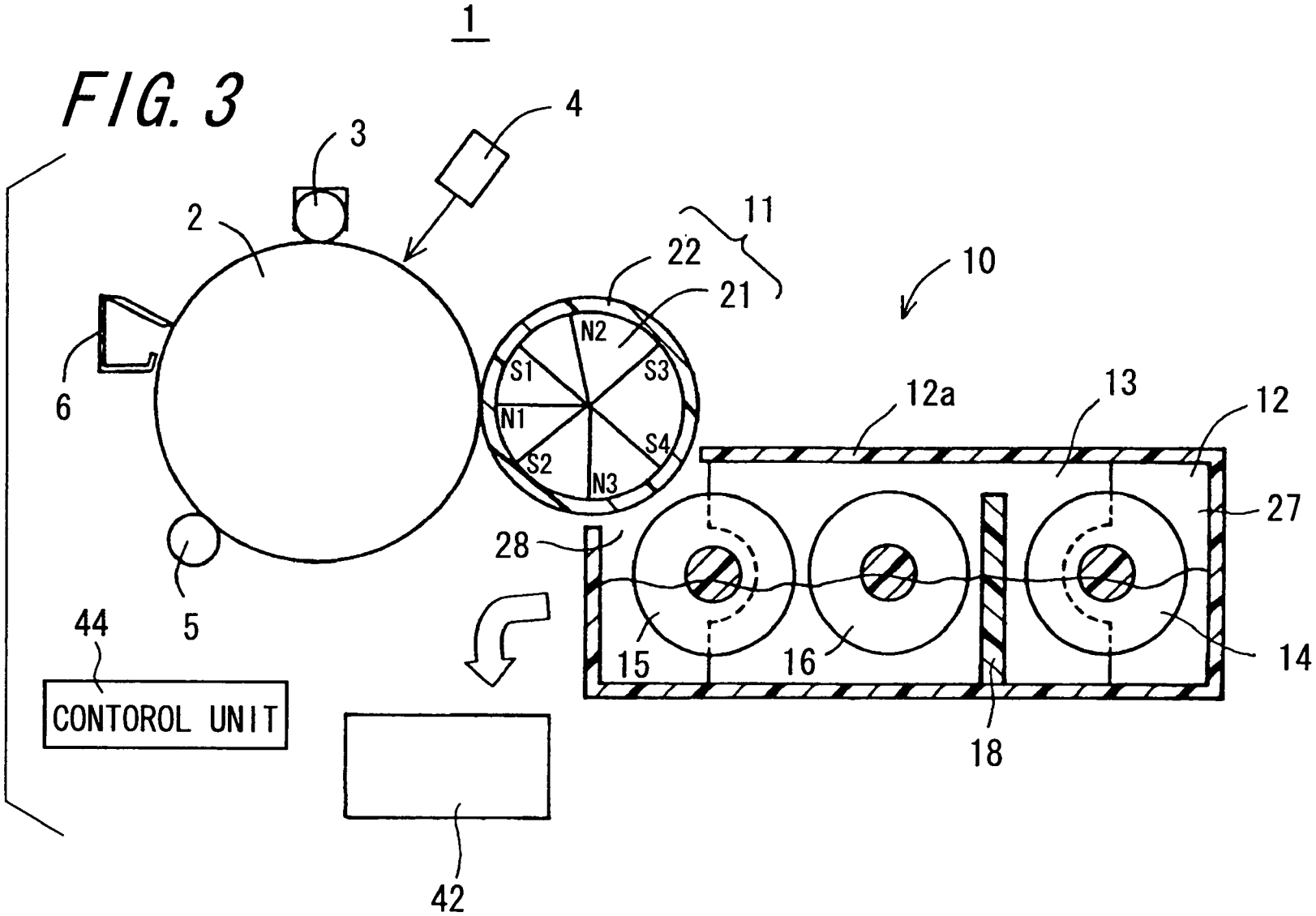
FIG. 3 is a simplified sectional view showing a constitution of a main part of the image forming apparatus in which the developing device shown in FIGS. 1A and 1B is mounted.

FIGS. 1A and 1B are simplified views showing a constitution of a developing device 10 in one embodiment. FIG. 1A is a top view showing an internal constitution of a developing tank 12 in the developing device 10. FIG. 1B is a sectional view showing an internal constitution of an agitating region tank 24 in the developing device 10, viewed from an end portion of the agitating region tank 24. Note that a graphic representation of the developing tank wall, existing on an upper portion of the developing tank 12 in the vertical direction of the developing tank 12, is omitted in FIG. 1A in order to show clearly an internal constitution of the developing tank 12. FIG. 2 is an enlarged top view showing a constitution of a main part of the developing device 10, shown in FIGS. 1A and 1B. FIG. 3 is a simplified sectional view of a constitution of a main part of an image forming apparatus 1 in which the developing device 10 is mounted. The developing device 10 is disposed, in the electrophotographic image forming apparatus 1, such that a developer bearing member 11, which is one of the constitution members thereof, faces a photoreceptor drum 2, and an axis of the developer bearing member 11 is in parallel with a rotation axis of the photoreceptor drum 2.

That is, the image forming apparatus 1 includes the photoreceptor drum 2, a charging section 3, an exposure section 4, the developing device 10, a transfer section 5 and a cleaning section 6. The photoreceptor drum 2 is a roller-shaped member supported rotatably, having a photosensitive layer (not illustrated), in order to form an electrostatic latent image on a surface thereof. The charging section 3 charges the photosensitive layer on the surface of the photoreceptor drum 2 up to a predetermined electric potential and in a predetermined polarity. In the embodiment, a charging roller is used, however, not limited thereto, a brush type charging device, a charger type charging device, a corona charging device such as a scorotron, or the like, can be used. The exposure section 4 forms an electrostatic latent image on the charged photosensitive layer of the photoreceptor drum 2 by irradiating it with signal light corresponding to image information. As the exposure section 4, for example, a semiconductor laser can be used. The developing device 10 supplies the toner to the electrostatic latent image on the photosensitive layer of the photoreceptor drum 2, for example, by taking advantage of a difference in electric potential, so that the electrostatic latent image is developed and a toner image is formed. The transfer section 5 transfers the toner image on the photoreceptor drum 2 onto a recording medium or an intermediate transfer medium (not illustrated). In the embodiment, a transfer roller which is in press contact with the photoreceptor drum 2 and supported rotatably, is used. The cleaning section 6 removes the toner remaining on the surface of the photoreceptor drum 2 after a transfer operation by the transfer section 5. In the embodiment, as the cleaning section 6, a cleaning device including a cleaning blade and a toner storing vessel is used. The cleaning blade is disposed in press contact with the surface of the photoreceptor drum 2, thereby the toner on the surface of the photoreceptor drum 2 is removed. The toner storing vessel temporarily stores the toner removed by the cleaning blade.

Next, the respective members constituting the developing device 10 will be explained. The developing device 10 includes the developer bearing member 11, the developing tank 12, a partition wall member 13, a first agitating and conveying member 14, a second agitating and conveying member 15, a third agitating and conveying member 16, a first intermediate wall member 17, a second intermediate wall member 18 and a sensor 19.

The developer bearing member 11 is a roller-shaped member supported by a main body of the developing device 10 and disposed to be rotated by a driving mechanism (not illustrated). The developer bearing member 11 bears a developer on a surface thereof. In the embodiment, the developer bearing member 11 is a magnet roller including a magnet member 21 and a developing sleeve 22. The magnet member 21 is made of, for example, permanent magnet segments, N poles and S poles thereof being disposed almost alternately in its circumferential direction, and the magnet member 21 has a cylindrical shape on the whole. The developing sleeve 22 is a column-shaped member made of a nonmagnetic material such as synthetic resin, the developing sleeve 22 surrounding the magnet member 21 and being disposed rotatably on the outer circumference of the magnet member 21. The developer borne on the developer bearing member 11 is a two-component developer including a toner and a carrier. As the carrier, a magnetic material such as iron powder and ferrite is used. On the developer bearing member 11 and in the developing tank 12, the two-component developer is in a state where the toner adheres on the surface of the carrier. The two-component developer sticks on the surface of the developer bearing member 11, i.e., the surface of the developing sleeve 22 by a magnetic force of the magnet member 21, so that a magnetic brush comprising a series of spikes-shaped pieces of the two-component developer is formed. In this way, the two-component developer is borne on the developing bearing member 11 in the form of the magnetic brush. The toner having the charge in the two-component developer forming the magnetic brush is supplied from the developing bearing member 11 to the photoreceptor drum 2 according to a potential difference between the developing bearing member 11 and the photoreceptor drum 2, so that the electrostatic latent image is developed and the toner image is formed. Hereinafter, if not otherwise specified, the two-component developer is simply referred to as the "developer".

The developing tank 12 is a vessel-like member whose outer appearance is substantially a rectangular parallelepiped, the developing tank 12 being formed such that a length in a longitudinal direction thereof is longer than a length L1 in an axial direction of the developer bearing member 11. The developing tank 12 includes a developing region tank 23, an agitating region tank 24 and the partition wall member 13.

The developing region tank 23 faces the developer bearing member 11 along the entire length of the developer bearing member 11, is disposed such that a length in the longitudinal direction of the developing region tank 23 is longer than the length L1 in the axial direction of the developer bearing member 11, and supplies the developer to the developer bearing member 11. Note that the length in the longitudinal direction of the developing region tank 23 is shorter than a length in the longitudinal direction of the developing tank 12. An opening portion 26 is formed on the developing region tank 23. The opening portion 26 is formed in the developing tank wall 12*a*, at a location on a downstream side of the developer bearing member 11 in an agitating and conveying direction of the developer (the direction of an arrow 37) by the second agitating and conveying member 15 described below and facing the second agitating and conveying member 15. In the developer released from the developer bearing member 11, the toner density is low and the carrier density is high because of immediate aftermath of a supply of the toner to the electrostatic latent image on the photoreceptor drum 2. Also, an external stress has been applied to the carrier by a regulating blade as a member for regulating ear of the developer (not illustrated), disposed in vicinity to the surface of the developer bearing member 11, so that deterioration of the carrier has been progressed compared to a new carrier. Herein, deterioration means a state in which a covering layer of the carrier is peeled off from the surface thereof, the toner is fastened on the surface of the carrier (i.e., spent), and so on. Such a carrier cannot charge the toner normally, so that the image quality is degraded. The developer released from the surface of the developer bearing member 11 and containing the deteriorated carrier in high concentration is conveyed in a direction of the arrow 37 by the second agitating and conveying member 15. Therefore, the deteriorated carrier can be almost selectively discharged outside the developing tank 12 by forming the opening portion 26 near the downstream side of the developer bearing member 11 in the direction of the arrow 37.

Figure 4:
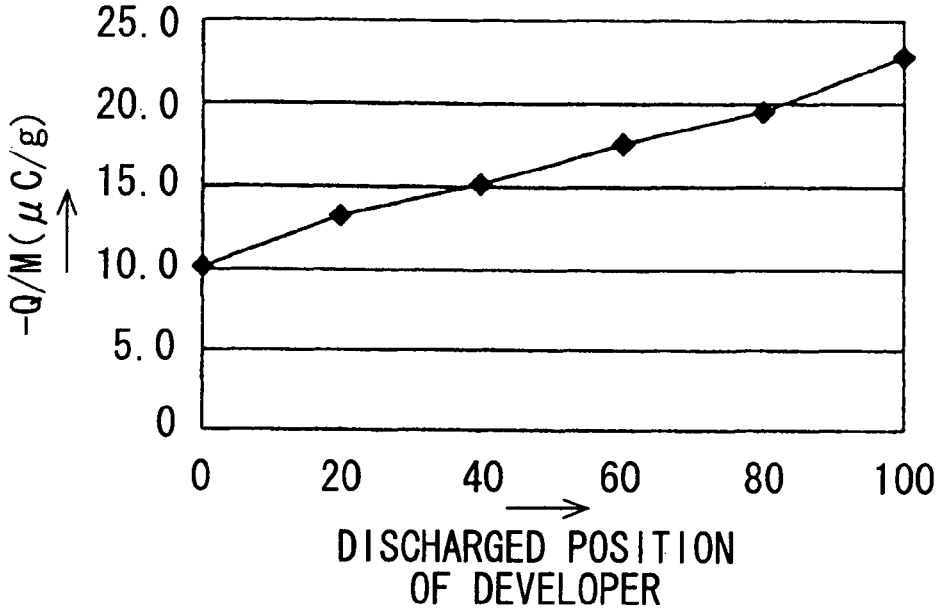
FIG. 4 is a graph showing a relationship between a position within a developing tank and a toner charge amount.

FIG. 4 is a graph showing a relationship between a position within the developing tank and a toner charge amount. With respect to the position in the developing tank, "0" means the position of the opening portion 26 and "100" means the position where the mixture 41 of the toner and the carrier is newly replenished (a developer replenishing port 45 of the agitating region tank 24). Based on FIG. 4, a charge amount as high as 23 μC/g can be applied to the toner by the carrier at the position "100", whereas the charge amount that can be applied to the toner is lowered to 10 μC/g at the position "0", so that it is recognized that the deterioration of the carrier is progressed. Therefore, it is also recognized that the opening portion 26 is preferably formed near the developer bearing member 11 on the downstream side in the direction of the arrow 37. The redundant developer overflowing through the opening portion 26 is stored in a recovering vessel 42 disposed outside the developing tank 12, through a discharging path (not illustrated) which is in communication with the opening portion 26, and the developer is recovered therefrom.

The agitating region tank 24 is in connection with the developing region tank 23 and is disposed at a part of the developing tank 12 not facing the developer bearing member 11. The agitating region tank 24 agitates and conveys the mixture 41 of the toner and the carrier, replenished from outside, with the developer, and supplies the mixture 41 therewith to the developing region tank 23, and recovers the developer from the developing region tank 23. The agitating region tank 24 is provided with a developer replenishing port 45. The developer replenishing port 45 is preferably formed in the developing tank wall 12*a* of the agitating region tank 24 at an upper portion in the vertical direction. The position where the developer replenishing port 45 is formed is preferably on the developing tank wall 12*a* above the second agitating and conveying member 15 and the third agitating and conveying member 16, described below, in the vertical direction. More preferably, the position is on the developing tank wall 12*a* above the second agitating and conveying member 15 and the third agitating and conveying member 16, described below, in the vertical direction, and located nearer the partition wall member 13. By forming the developer replenishing port 45 at that position, agitating time can be sufficiently secured in a time period from the replenishment of the mixture 41 of the toner and the carrier to the agitating region tank 24 to the supply thereof to the developer bearing member 11. Therefore, the replenished mixture 41 of the toner and the carrier is sufficiently agitated with the developer originally existing in the developing tank 12, so that the uniform developer is supplied to the developer bearing member 11.

A toner hopper 43 is provided above the agitating region tank 24 in the vertical direction. The toner hopper 43 is a vessel-like member having an inner space in which the mixture 41 of the toner and the carrier is housed. The toner hopper 43 is, for example, formed of synthetic resin or the like. A developer supplying port is formed on the toner hopper 43, and a developer supply roller 40 is provided in the inner space thereof. The developer supplying port is formed on the lower portion of the toner hopper 43 in the vertical direction. The toner hopper 43 is disposed such that the developer supplying port is in communication with the developer replenishing port 45 of the agitating region tank 24. The developer supply roller 40 is a roller-shaped member, which is supported rotatably by the toner hopper 43 and disposed near the developer supplying port inside the toner hopper 43, and is so arranged as to be rotated by a driving mechanism (not illustrated) with an outer periphery thereof in sliding contact with the developer supplying port. As the developer supply roller 40, for example, a roller-shaped member including a metal core and an elastic layer made of a porous elastic material such as an urethane foam formed on a surface of the metal core, is used. When the developer supply roller 40 is rotated, the mixture 41 of the toner and the carrier within the toner hopper 43 is dropped through the developer supplying port and is replenished through the developer replenishing port 45 into the agitating region tank 24. The replenishment of the mixture 41 of the toner and the carrier is, for example, carried out by rotating the developer supply roller 40 in response to a control signal from a control portion in a control unit 44 based on the toner density in the developer in the developing region tank 23. When the developer supply roller 40 is rubbed with the developer supplying port, the mixture 41 of the toner and the carrier is separated and dropped from the developer supply roller 40, thereby the mixture 41 is replenished into the agitating region tank 24 through the developer replenishing port 45. The control thereof is described later more in detail.

The partition wall member 13 is a plate-like member separating the developing region tank 23 and the agitating region tank 24 from each other, which is so disposed as to extend, in a transverse direction of the developing tank 12, from the developing tank wall 12*a* on the lower portion of the developing tank 12 in the vertical direction toward the developing tank wall 12*a* on the upper portion in the vertical direction, and to be in contact with an inside wall surface of the developing tank wall 12*a* at the upper portion thereof in the vertical direction. The partition wall member 13 separates the developing region tank 23 and the agitating region tank 24 not in such a manner that the both tanks 23 and 24 have an independent space respectively, but in such a manner that the first agitating and conveying member 14 and the second agitating and conveying member 15, described below, penetrate the partition wall member 13 along the longitudinal direction of the developing tank 12. Also, space portions, i.e., a first space 27 and a second space 28, are formed between both ends of the partition wall member 13 and the developing tank wall 12*a*, respectively, in the transverse direction of the developing tank 12, so that the developing region tank 23 is in communication with the agitating region tank 24. Therefore, although the partition wall member 13 is disposed, the developer can be agitated and conveyed from the agitating region tank 24 to the developing region tank 23, or from the developing region tank 23 to the agitating region tank 24. By disposing the partition wall member 13, the flow of the developer within the developing tank 12 is further stabilized, so that the developer is efficiently agitated and the toner can be uniformly charged. In particular, in the agitating region tank 24, the newly supplied mixture 41 of the toner and the carrier, and the developer already existing in the agitating region tank 24 can be mixed uniformly, so that it is easy to respond to the high image forming speed.

The first agitating and conveying member 14 is a screw-like member rotated around an axis thereof by a driving mechanism (not illustrated), which member is supported rotatably by the developing tank 12. The first agitating and conveying member 14 is disposed such that the axis thereof is in parallel with the axis of the developer bearing member 11 from the agitating region tank 24 to the developing region tank 23 in the longitudinal direction of the developing tank 12. The first agitating and conveying member 14, by the rotation thereof, conveys the developer, in an extended direction beyond the length L1 of the developer bearing member 11, in the longitudinal direction of the developing tank 12, that is, in the direction of an arrow 31 heading toward the first space 27 from a vicinity of an end portion 29 on the side of the agitating region tank 24 along the inside wall surface of the developing tank wall 12*a* in the longitudinal direction. A part of the developer conveyed towards the first space 27 passes through the first space 27 and is conveyed into the developing region tank 23, and another part thereof hits against the partition wall member 13 and is then conveyed in the direction of an arrow 32 along the wall surface of the partition wall member 13 on the side of the agitating region tank 24. The developer passing through the first space 27 is further agitated and conveyed in the direction of an arrow 35 along the inside wall surface of the developing tank wall 12*a* in the longitudinal direction, hits against an inside wall surface 30*a* of the developing tank wall 12*a* near an end portion 30 of the developing tank 12 on the side of the developing region tank 23 in the longitudinal direction, and is conveyed in the direction of an arrow 36 along the inside wall surface 30*a* of the developing tank wall 12*a*. The developer conveyed in the direction of the arrow 32 meets a flow of the developer in the direction of an arrow 33*a*, described below, in vicinity to the second space 28 within the agitating region tank 24.

The second agitating and conveying member 15 is a screw-like member, which is supported rotatably by the developing tank 12 and rotated around an axis thereof by a driving mechanism (not illustrated). The second agitating and conveying member 15 is disposed such that an axis thereof is in parallel with the axes of the developer bearing member 11 and the first agitating and conveying member 14, from the agitating region tank 24 to the developing region tank 23, between the developer bearing member 11 and the first agitating and conveying member 14 in the longitudinal direction of the developing tank 12. The second agitating and conveying member 15, by the rotation thereof, conveys the developer having been conveyed in the direction of the arrow 36 in the direction toward the partition wall member 13 along the periphery of the developer bearing member 11, i.e., in the direction of the arrow 37. A part of the developer conveyed in the direction of the arrow 37 passes through the second space 28 and is conveyed into the agitating region tank 24, and another part thereof hits against the partition wall member 13 thereby changes the direction thereof, and is then conveyed in the direction of an arrow 38 along the wall surface of the partition wall member 13 on the side of the developing region tank 23. The developer conveyed in the direction of the arrow 38 meets a flow of the developer in the direction of the arrow 35 in vicinity to the first space 27 within the developing region tank 23. On the other hand, the developer passing through the second space 28 is conveyed directly in the direction of an arrow 33 along the inside wall surface of the developing tank 12 in the longitudinal direction, and hits against the inside wall surface 29*a* on the side of the end portion 29 thereby changes the direction thereof, is then conveyed in the direction of an arrow 34 along the inside wall surface 29*a* on the side of the end portion 29 and meets a flow of the developer in the direction of an arrow 31.

The third agitating and conveying member 16 is a screw-like member, which is supported rotatably by the developing tank 12 (more in detail, the developing tank wall of the developing tank 12 on the side of the end portion 29 and the partition wall member 13 disposed in parallel with the developing tank wall) and is rotated around an axis thereof by a driving mechanism (not illustrated). The third agitating and conveying member 16 is disposed such that an axis thereof is in parallel with the axes of the first agitating and conveying member 14 and the second agitating and conveying member 15, between the first agitating and conveying member 14 and the second agitating and conveying member 15, in the longitudinal direction of the agitating region tank 24. The third agitating and conveying member 16 is disposed so as to convey the developer in the same direction as the second agitating and conveying member 15. The third agitating and conveying member 16 mainly agitates and conveys the developer existing between the third agitating and conveying member 16 and the second agitating and conveying member 15 in the direction of the arrow 33*a*. The developer conveyed in the direction of the arrow 33*a* hits against the inside wall surface 29*a* of the developing tank wall 12*a* on the side of the end portion 29 and meets a flow of the developer in the direction of the arrow 34. Between the third agitating and conveying member 16 and the second agitating and conveying member 15, the mixture 41 of the toner and the carrier is replenished through the developer replenishing port 45 formed on the developing tank wall 12*a* of the agitating region tank 24 above in the vertical direction. The mixture is, by the rotation of both the agitating members 15 and 16, conveyed in the direction of the arrow 33*a* while being subjected to a primary mixing with the developer originally existing within the agitating region tank 24, subsequently conveyed in the direction of the arrow 34 while being subjected to a secondary mixing, and further conveyed in the direction of the arrow 31 while being subjected to a tertiary mixing. By disposing the third agitating and conveying member 16, even when the mixture 41 of the toner and the carrier is voluminously and sequentially replenished in the developing tank 12 in response to the high image forming speed, the mixture is uniformly mixed with the developer in the developing tank 12 by the several steps of mixing, so that the toner density in the developer is kept approximately constant. Therefore, by disposing the third agitating and conveying member 16, the high image forming speed is further facilitated.

Figure 5:
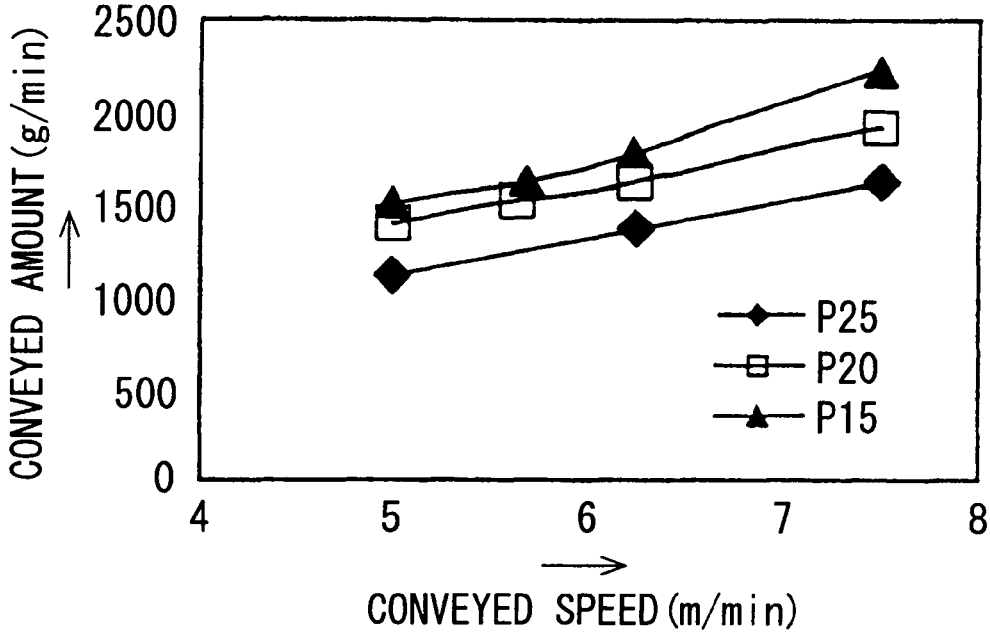
FIG. 5 is a graph showing a relationship between an agitating and conveying speed and a conveyed amount of a developer by a screw member.

In the first agitating and conveying member 14, the second agitating and conveying member 15 and the third agitating and conveying member 16, it is important to appropriately select the shape, the speed of the rotation or the like in accordance with, for example, the image forming speed that may be set to the image forming apparatus 1. FIG. 5 is a graph showing a relationship between an agitating and conveying speed (m/min) and a conveyed amount (g/min) of the developer by a screw member, in a case where the agitating and conveying member is the screw member. Owing to the screw member, the agitating and conveying speed and the conveyed amount of the developer are substantially proportional to each other. In the graph of FIG. 5, "P25" indicates that the screw pitch in the screw member is 25 mm. "P20" indicates that the screw pitch in the screw member is 20 mm. "P15" indicates that the screw pitch in the screw member is 15 mm. From FIG. 5, it is recognized that the conveyed amount of the developer is varied depending on the pitch in the screw member. Although only the pitch is shown in FIG. 5, the conveyed amount of the developer is also varied depending on an inclined angle of a blade, thickness of the shaft and an outside diameter of the blade. Furthermore, the conveyed amount of the developer is also varied depending on the kind of the developer and the flow property thereof. Note that, the first agitating and conveying member 14, the second agitating and conveying member 15 and the third agitating and conveying member 16, may be set to have the same or approximately the same developer conveying ability as that of each other, or may be set to have different developer conveying abilities from each other. When the developer conveying ability is set to be the same or approximately the same as that of each other, the cost can be reduced by using components of common design for the parts of the screw members, such as an agitating blade, a shaft and a bearing. When their conveying abilities are set to be different from each other, any changes in the flow property of the developer can be responded to.

The first intermediate wall member 17 is a plate-like member disposed in parallel with the first agitating and conveying member 14 and the second agitating and conveying member 15 between these agitating and conveying members 14 and 15 in the longitudinal direction of the developing region tank 23. More in detail, the first intermediate wall member 17 is a plate-like member, which extends in the longitudinal direction of the developing region tank 23 and is disposed so as to rise upwardly in the vertical direction from the inside wall surface 12*a* at a bottom of the developing region tank 23 in the vertical direction between the first agitating and conveying member 14 and the second agitating and conveying member 15. The first intermediate wall member 17 is disposed such that a length in the longitudinal direction thereof is shorter than that of the developing region tank 23 in the longitudinal direction. Therefore, both end portions of the first intermediate wall member 17 in the longitudinal direction of the developing region tank 23 are formed such that one end is spaced with respect to the wall surface of the partition wall member 13 on the side of the developing region tank 23, and the other end is spaced with respect to the inside wall surface 30*a* of the developing tank wall 12*a* on the side of the end portion 30. In the space between the one end of the first intermediate wall member 17 in the longitudinal direction of the developing region tank 23 and the partition wall member 13, the flow of the developer in the direction of the arrow 38 is caused. Also, in the space between the other end of the first intermediate wall member 17 in the longitudinal direction of the developing region tank 23 and the inside wall surface 30*a* of the developing tank wall 12*a*, the flow of the developer in the direction of the arrow 36 is caused. In this way, in the developing region tank 23, a circulating flow of the developer in the directions of the arrows 35, 36, 37 and 38 is formed by the first agitating and conveying member 14 and the second agitating and conveying member 15, the partition wall member 13 and the first intermediate wall member 17. In the embodiment, as the first intermediate wall member 17, a plate-like member made of synthetic resin is used. The synthetic resin may contain various types of additives. The additives are, for example, general inorganic fillers or the like, improving the mechanical strength of the plate-like member.

The second intermediate wall member 18 is a plate-like member disposed in parallel with the first agitating and conveying member 14 and the third agitating and conveying member 16 between these agitating and conveying members 14 and 16 in the longitudinal direction of the agitating region tank 24. More in detail, the second intermediate wall member 18 is a plate-like member, which extends in the longitudinal direction of the agitating region tank 24 and is disposed so as to rise upwardly in the vertical direction from the inside wall surface of the developing tank wall 12*a* at a bottom portion of the agitating region tank 24 in the vertical direction between the first agitating and conveying member 14 and the third agitating and conveying member 16. As the second intermediate wall member 18, a plate-like member made of the same material as the first intermediate wall member 17 can be used. Both end portions of the second intermediate wall member 18 in the longitudinal direction of the agitating region tank 24 are formed such that one end is spaced with respect to the wall surface of the partition wall member 13 on the side of the agitating region tank 24, and the other end is spaced with respect to the inside wall surface 29*a* of the developing tank wall 12*a* on the side of the end portion 29. In the space between the one end of the second intermediate wall member 18 in the longitudinal direction of the agitating region tank 24 and the partition wall member 13, the flow of the developer in the direction of the arrow 32 is caused. Also, in the space between the other end of the second intermediate wall member 18 in the longitudinal direction of the developing tank 24 and the inside wall surface 29*a* of the developing tank wall 12*a*, the flow of the developer in the direction of the arrow 34 is caused. In this way, in the agitating region tank 24, a circulating flow of the developer in the directions of the arrows 31, 32, 33*a* and 34 is formed by the first agitating and conveying member 14, the second agitating and conveying member 15 and the third agitating and conveying member 16, the partition wall member 13 and the second intermediate wall member 18. Most part of the developer flowing in the direction of the arrow 32 meets the flow in the direction of the arrow 33*a*. Therefore, the flow in the direction of the arrow 32, at the confluent position with the flow in the direction of the arrow 33, does not disturb the flow in the direction of the arrow 33. On the other hand, for example, in a constitution where the third agitating and conveying member 16 is not disposed but the second intermediate wall member 18 is disposed at the middle position between the first agitating and conveying member 14 and the second agitating and conveying member 15 in the transverse direction of the agitating region tank 24, the flow in the direction of the arrow 33 may be disturbed. That is, the flow in the direction of the arrow 33*a* is not caused by the constitution, so that the flow in the direction of the arrow 32 directly meets the flow in the direction of the arrow 33 near the opening portion 26, causing a flow which pushes the flow in the direction of the arrow 33 back in the contraflow direction thereof. The pushback flow acts so as to prevent the developer from being discharged through the opening portion 26 in the proper amount. Therefore, the amount of the developer discharged through the opening portion 26 is reduced and the total amount of the developer in the developing tank 12 is increased, so that there is a fear that the agitating thereof is insufficient to charge the toner in the proper amount. Further, the flow in the direction of the arrow 32 is weakened, so that there is a fear that the agitating and conveying of the developer are insufficient in the agitating region tank 24. The second intermediate wall member 18 is disposed such that a length in the longitudinal direction thereof is shorter than that of the agitating region tank 24 in the longitudinal direction.

Figure 6A:
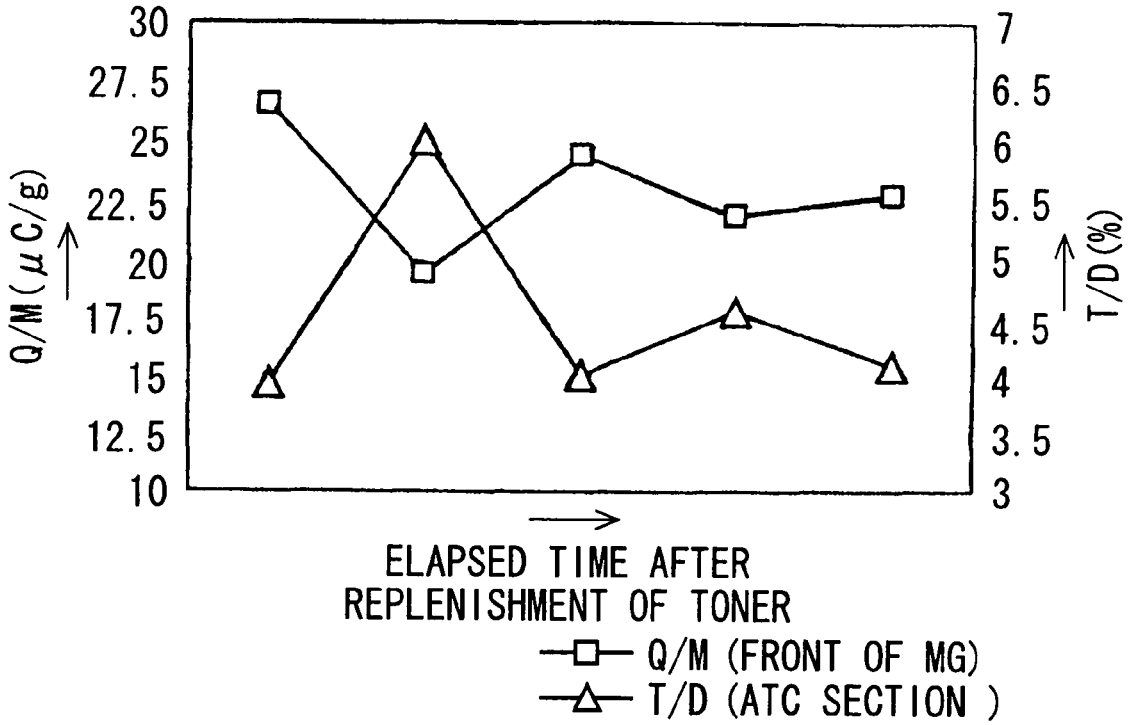
FIGS. 6A and 6B are graphs showing a relationship between elapsed time after replenishment of a toner, and a toner density in the developer and the toner charge amount in the developing device.
Figure 6B:
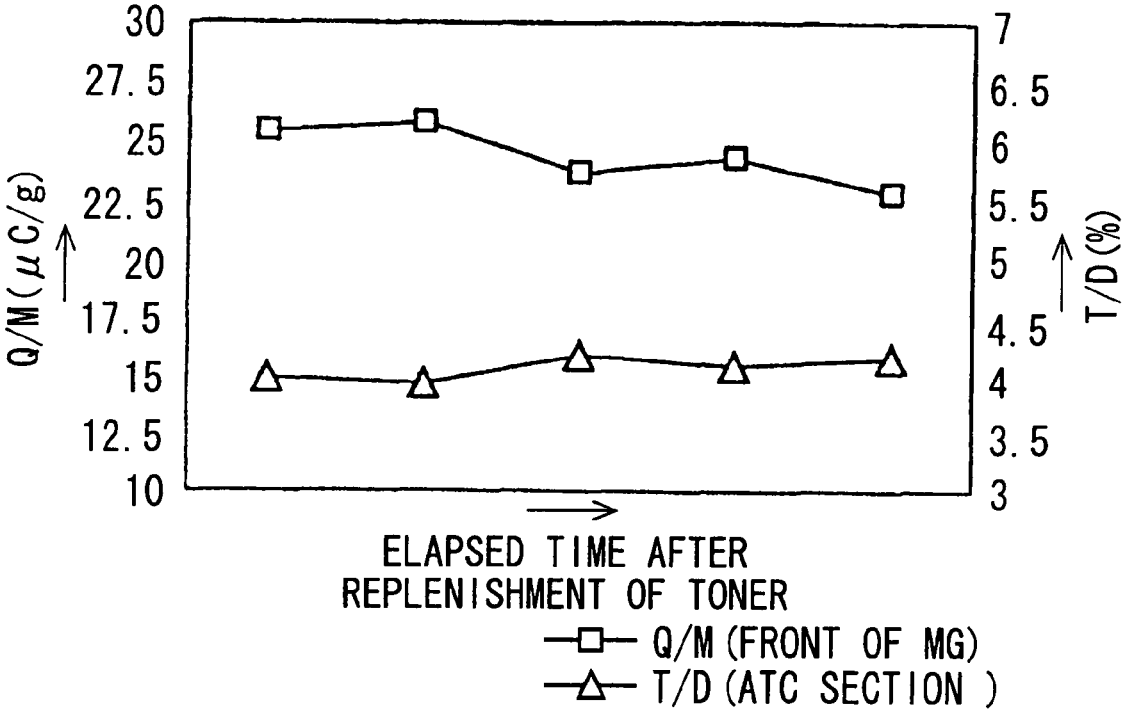

The circulating flow in the directions of the arrows 31, 32, 33*a* and 34 in the agitating region tank 24 has a higher toner density than the circulating flow in the directions of the arrows 35, 36, 37 and 38 in the developing region tank 23 in general, because the mixture 41 of the toner and the carrier is replenished in the agitating region tank 24. On the other hand, a large circulating flow in the directions of the arrows 31, 35, 36, 37, 33 and 34 is caused in the developing tank 12. The circulating flow in the agitating region tank 24 and the circulating flow in the developing region tank 23 are further uniformly mixed with each other by the large circulating flow in the developing tank 12, so that the toner density in the developer in the developing tank 12 is uniformed. Even when the mixture 41 of the toner and the carrier is replenished, and thereby the toner density in the circulating flow in the agitating region tank 24 is temporarily increased, the toner density in the developer in the developing tank 12 is uniformed within a relatively short time. This is apparent from FIGS. 6A and 6B. FIGS. 6A and 6B are graphs showing a relationship between elapsed time after replenishment of the toner, and a toner density T/D (%) in the developer and a toner charge amount Q/M (μC/g) near the developer bearing member 11 in the developing device. FIG. 6A shows a case in which the developing device has a developing tank not provided with the agitating region tank, and FIG. 6B shows the case of the developing device 10. The toner density T/D is a value detected by an ATC sensor, and is indicated by "-Δ-" in FIGS. 6A and 6B. The toner charge amount Q/M is indicated by "-□-" in FIGS. 6A and 6B. From FIGS. 6A and 6B, in the developing device not provided with the agitating region tank, it is clear that neither the toner density T/D nor the toner charge amount Q/M is stabilized and the variation is wide even after a certain time has elapsed since the replenishment of the toner. On the other hand, in the developing device 10, it is clear that both the toner density T/D and the toner charge amount Q/M are almost stabilized in a short time after the replenishment of the toner. Therefore, in the developing device 10, even when the replenished amount of the mixture 41 of the toner and the carrier is increased in response to the high image forming speed, there is no need to increase the rotation speed of the first agitating and conveying member 14 and the second agitating and conveying member 15, so that the external stress applied to the carrier is not increased, thereby the durable life of the carrier can be extended.

The sensor 19 is mounted on the developing tank wall 12*a*, in a position on the upstream side of the developer bearing member 11 in the agitating and conveying direction of the developer by the first agitating and conveying member 14, i.e., in the direction of the arrows 35 and 36, and facing the first agitating and conveying member 14. The sensor 19 detects the toner amount in the developer, more in detail, the toner density which is a compounding ratio of the carrier and the toner in the developer. As the sensor 19, a magnetic permeability sensor, a piezoelectric detection sensor or the like can be used. The magnetic permeability sensor detects magnetic permeability of the developer and magnetism of the carrier in a case where a magnetic material such as iron powder and ferrite is used as the carrier. From the magnetic permeability and the magnetism, a density and a change in the density of the magnetic material (the carrier) and nonmagnetic material (the toner) in the developer, a mixing ratio thereof, and the like, can be determined. As the piezoelectric sensor, for example, a self-excited oscillating piezoelectric sensor is used. In the self-excited oscillating piezoelectric sensor, when a load is gradually increased from an unloaded condition without a powder load with respect to the detecting surface of the sensor, a gain of the sensor is decreased as the load is increased, and when a load exceeding a predetermined value is applied, the gain required for oscillation of the sensor can not be secured, so that the oscillation thereof is stopped. By taking advantage of such properties of the piezoelectric sensor, the toner density in the developer can be controlled.

By disposing the sensor 19 as described above, before the developer is borne on the surface of the developer bearing member 11, the toner density in the developer can be measured and controlled. In response to the result of the detection by the sensor 19, a supplied amount of the mixture 41 of the toner and the carrier from the toner hopper 43 to the agitating region tank 24 is controlled. The supplied amount is controlled by a control unit 44 provided with a CPU (Central Processing Unit), the control unit controlling all operations of the image forming apparatus 1 mounted on the developing device 10. The control unit 44 includes a storage portion, a calculation portion and a control portion. As the storage portion, ones commonly used in the art, for example, a read only memory (ROM), a random access memory (RAM), a hard disc drive (HDD) can be used. The result of the detection by the sensor 19 is inputted in the storage portion. In the storage portion, a relationship between the image forming speed and the toner density in the developer is preliminarily inputted as a table, and a setting value of the image forming speed is further inputted. The calculation portion retrieves the respective data inputted in the storage portion and determines whether or not the toner density is in a proper range with respect to the image forming speed at the time of the determination. When the calculation portion determines that the toner density is not in the proper range, the calculation portion further determines the amount of the toner to be replenished in order to make the toner density proper. In response to the result of the determination by the calculation portion, the control portion transmits a control signal to a driving mechanism which rotates the developer supply roller 40 in the toner hopper 43, and the developer supply roller 40 is rotated for a predetermined period of time. Thereby, the mixture 41 of the toner and the carrier is supplied into the developing tank 12, so that the toner density is controlled into the proper range. In this way, by disposing the sensor 19 on the upstream side of the developer bearing member 11, detecting the toner density in the developer immediately before being supplied to the developer bearing member 11, and controlling the toner density in response to the result of the detection by the sensor 19, the toner density in the developer can be controlled with a high accuracy. Further, the developer with the proper toner density can be always supplied to the developer bearing member 11, so that images each having high image density and good image quality can be stably formed.

Figure 7:
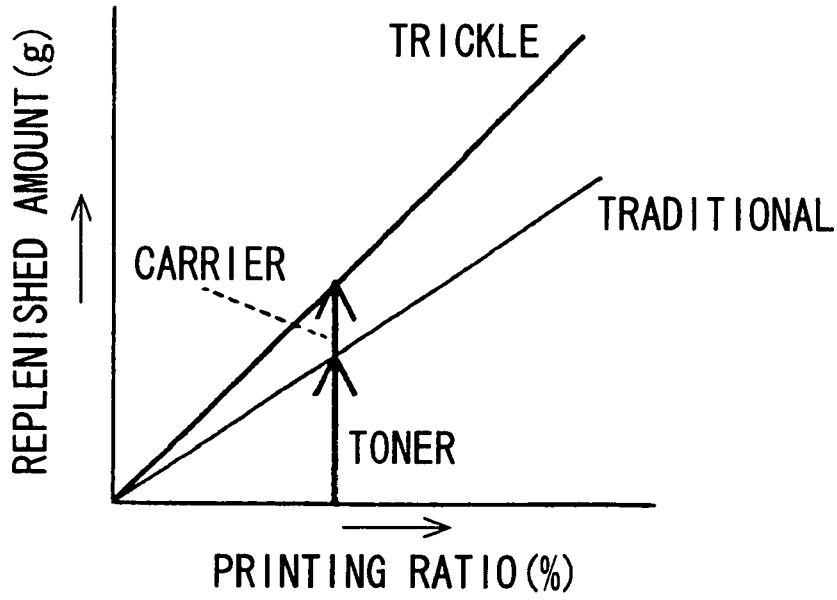
FIG. 7 is a graph explaining the trickle system.

The developing device 10 is a trickle system developing device, which replenish not only the toner but also the carrier to the developing tank 12 and discharges the redundant developer from the developing tank 12, as described above. FIG. 7 is a graph explaining the trickle system. In a conventional developing device, i.e., the developing device belonging to a system in which the carrier in the developing tank is exchanged in regular maintenance operations, only the toner is replenished to the developing tank, so that the replenished amount of the toner is increased as a printing ratio (%) is raised. On the other hand, in the trickle system, not only the toner but also the carrier is replenished, so that the replenished amount of the toner and the carrier is increased as the printing ratio (%) is raised. Herein, the toner is consumed and decreased, so that the further replenishment of the toner can be carried out, however, the carrier only charges the toner and is not consumed, so that when the carrier is replenished along with the toner, the developer becomes excessive by the replenished amount of the carrier. When the excessive amount of the developer is increased, an agitating efficiency of the toner and the carrier is lowered, so that a load applied to the developing tank on the whole is increased, thereby the durable period of the developing tank and the respective members provided in the developing tank is unduly shorten. For this reason, the amount of the developer in the developing tank needs to be always kept constant. Generally, a performance for keeping the amount of the developer constant is referred to as a response.

Figure 8:
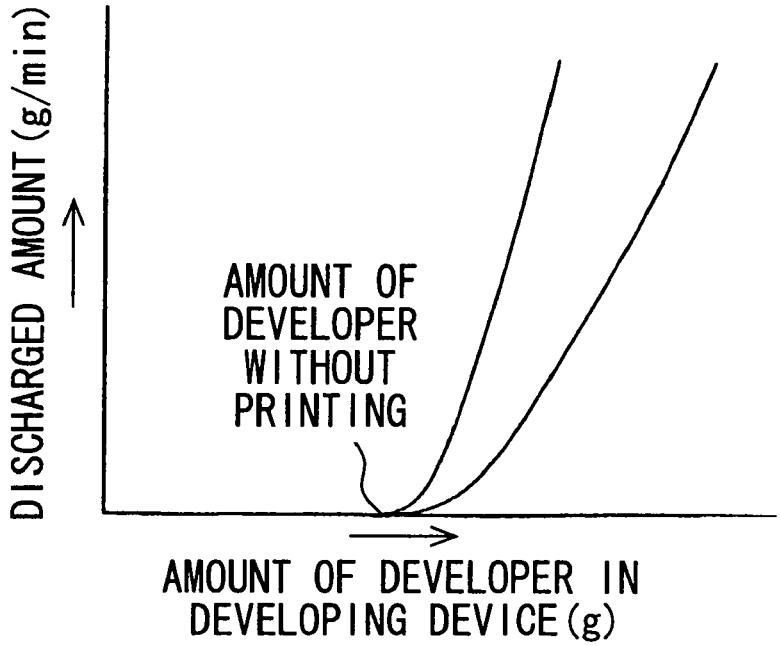
FIG. 8 is a graph explaining a conception of a response.

FIG. 8 is a graph explaining the conception of the response. As to two curves shown in the graph of FIG. 8, one curve whose slope is gentle indicates a bad response and the other curve whose slope is steep indicates a good response. In general, the amount of the developer replenished is controlled in response to the printing ratio (%) of images to be formed, in which the amount of the developer is increased as the printing ratio (%) is raised. When the new developer is replenished into the developing tank, the excess must be discharged outside the developing tank in response to the replenished amount. The printing ratio of manuscripts is not always constant, so that the replenished amount of the developer is relatively small on one occasion and relatively large on another occasion. That is, even when the discharged amount of the developer (g/min) is fluctuated, preferably the amount of the developer in the developing tank is always near constant. Therefore, in the graph of FIG. 8, the curve having the steeper slope and thus rather vertical is better in response.

Figure 9A:
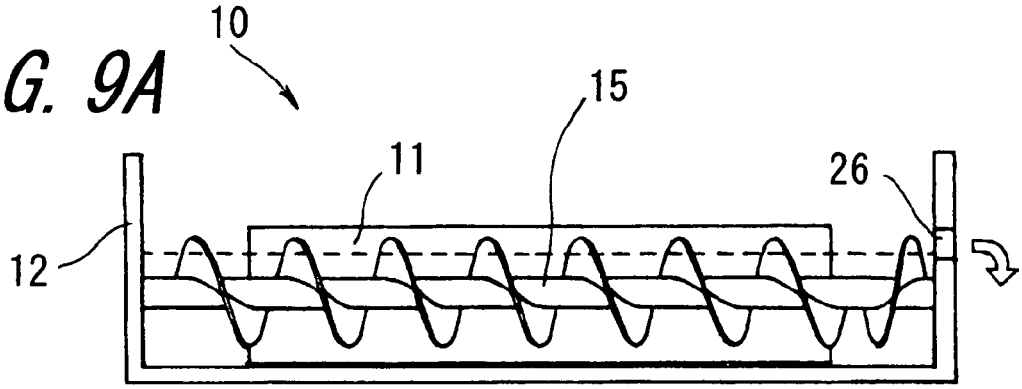
FIGS. 9A to 9C are drawings showing discharged amounts of the developer in different installation postures of the developing device.
Figure 9B:
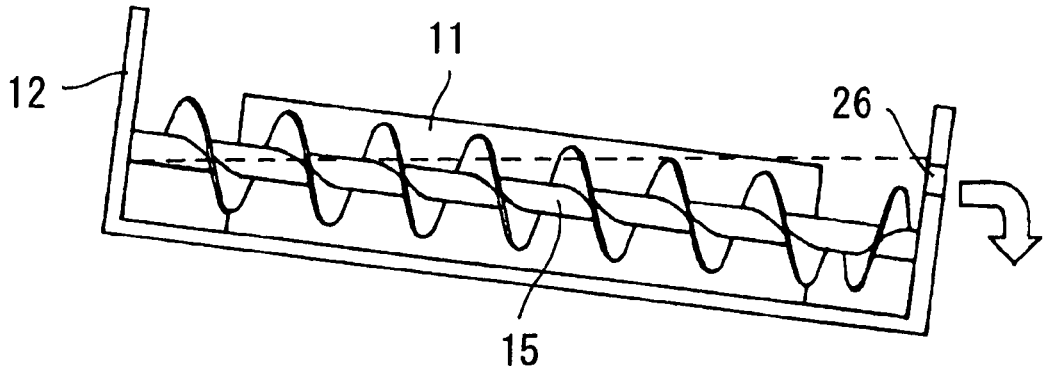
Figure 9C:
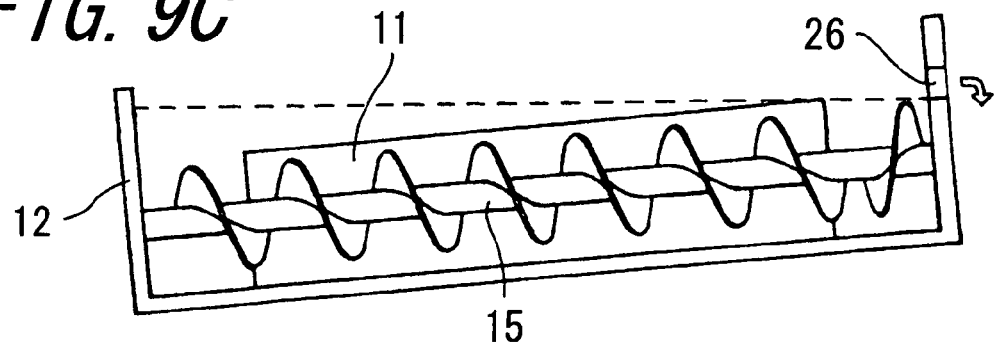
Figure 10:
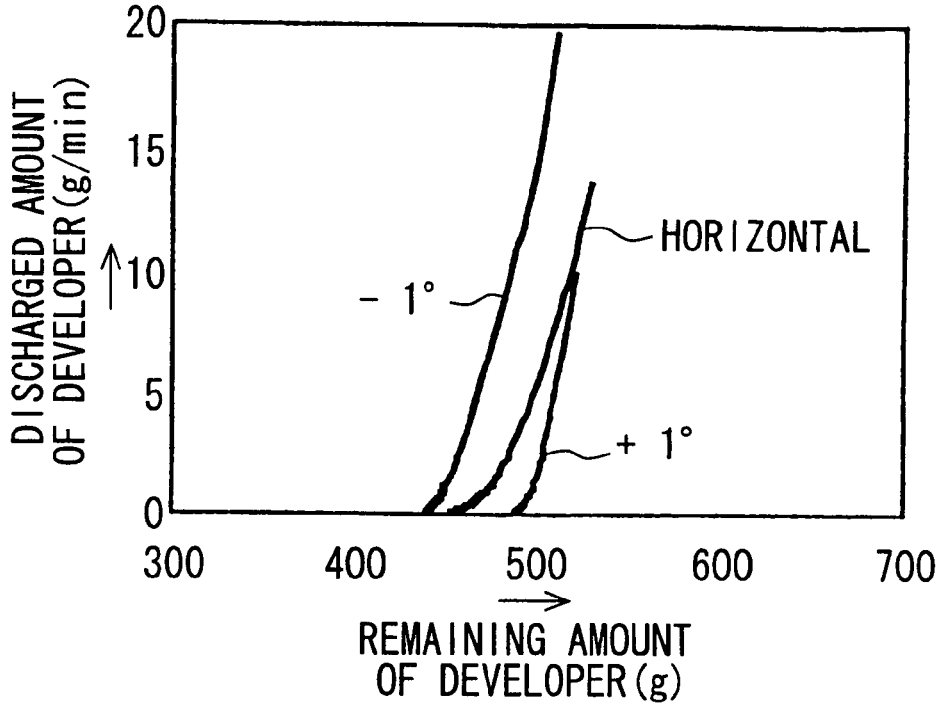
FIG. 10 is a graph showing responses in respective tilting cases of a comparative developing device.
Figure 11:
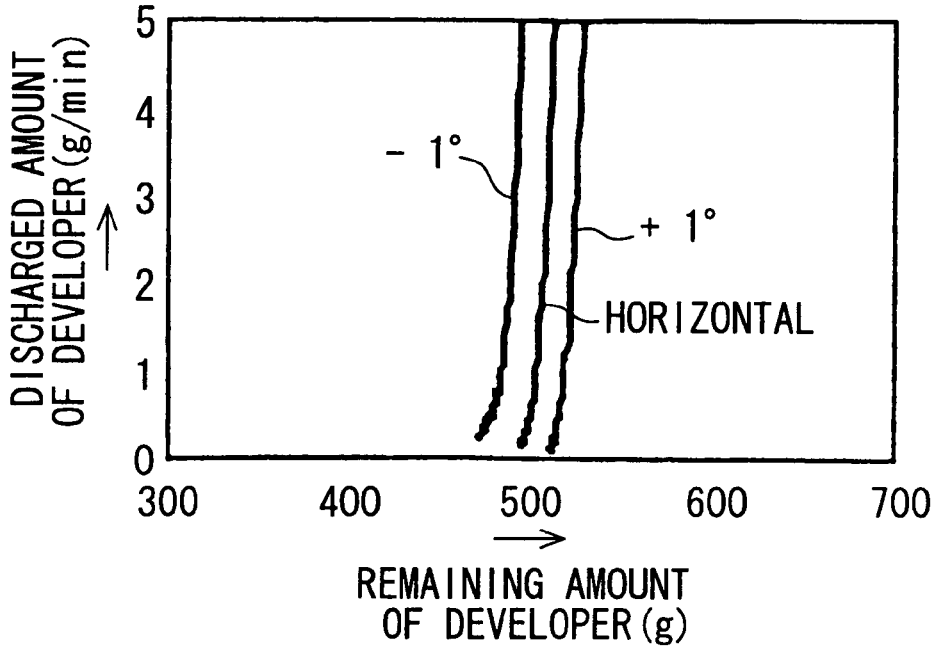
FIG. 11 is a graph showing responses in respective tilting cases in the developing device shown in FIGS. 1A and 1B.

In the trickle system developing device, a mechanism is adopted in which an opening portion for discharging the developer is formed on a lateral side of the developing tank in the vertical direction and the developer overflowing through the opening portion is discharged by its own weight. In such a mechanism, a tilt of the developing device when the developing device is installed, is important. FIGS. 9A to 9C are drawings showing discharged amounts of the developer in different installation postures of the developing device. FIG. 9A shows a case in which the developing device 10 is horizontally installed, FIG. 9B shows a case in which the developing device 10 is installed at −1° against the horizon (the side of the opening portion 26 is lower than the opposite side) and FIG. 9C shows a case in which the developing device 10 is installed at +1° against the horizon (the side of the opening portion 26 is higher than the opposite side), respectively. A proper amount of the developer is discharged when the developing device 10 is horizontally installed. On the other hand, when installed at −1°, the discharged amount of the developer is increased and the developer in the developing tank 12 is decreased, so that there is a fear for causing a trouble that the image density of the formed image is lowered, and so on. When installed at +1°, the discharged amount of the developer is decreased and the developer in the developing tank 12 is increased, so that there is a fear for causing a trouble of the poor agitating, or the like. FIG. 10 is a graph showing responses in respective tilting cases (horizontal, −1° and +1°) in the developing device described in Japanese Patent Application No. 2005-336160 previously filed by the inventors of the present application (hereinafter, referred to as the "comparative developing device"). The comparative developing device has the same constitution as the developing device 10, except that, in the agitating region tank 24 of the developing device 10, the third agitating and conveying member 16 is not provided and the second intermediate wall member 18 is disposed at the middle between the first agitating and conveying member 14 and the second agitating and conveying member 15 in the transverse direction of the agitating region tank 24. FIG. 11 is a graph showing responses in respective tilting cases in the developing device 10. It is recognized that the responses in respective tilting cases in the comparative developing device are good because the curves are almost vertical (the slopes are very steep). On the other hand, in FIG. 11, the curves in respective tilting cases in the developing device 10 are further almost vertical (the slopes are steeper) compared to those in respective tilting cases in the comparative developing device, and the curves in respective tilting cases in the developing device 10 are in almost parallel with each other, so that it is clear that the response in the developing device 10 is extremely excellent. Moreover, the discharged amount of the developer in the comparative developing device fluctuates in a range of 0 to 20 g/min, on the other hand, the discharged amount of the developer in the developing device 10 fluctuates in a narrower range of 0 to 5 g/min, so that it can be recognized that fluctuation of the remaining amount of the developer is extremely small and the response is high. Therefore, by using the developing device 10, even when the developing device 10 is disposed at a tilted place, lowering of the response is so small that flexibility in designing the image forming apparatus 1 is substantially increased.

The technology may be embodied in other specific forms without departing from the spirit or essential characteristics thereof. The present embodiments are therefore to be considered in all respects as illustrative and not restrictive, the scope of the technology being indicated by the appended claims rather than by the foregoing description and all changes which come within the meaning and the range of equivalency of the claims are therefore intended to be embraced therein.

What is claimed is:

1. A developing device which is provided in an electrophotographic image forming apparatus to supply a developer to a photoreceptor provided in the image forming apparatus and develop an electrostatic latent image formed on the photoreceptor, comprising:

a developer bearing member disposed rotatably so as to face the photoreceptor, for bearing the developer thereon;

a developing tank for housing the developer therein, a length of the developing tank being beyond a length in an axial direction of the developer bearing member, the developing tank being replenished with a mixture of toner and carrier, the developing tank including:

a developing region tank which agitates and conveys the developer and supplies the developer to the developer bearing member, an agitating region tank which is disposed at one end of the developing region tank and at a position beyond the length of the developer bearing member, wherein the agitating region tank agitates and conveys toner and carrier supplied into the developing tank with the developer already present in the developing tank and supplies the mixture to the developing region tank, and wherein the agitating region tank receives a part of the developer which has already been supplied to the developer bearing member but which was unconsumed and recovered from the developer bearing member, and a partition wall member which is disposed so as to separate the developing region tank from the agitating region tank;

a first agitating and conveying member which is disposed so as to extend from the agitating region tank to the developing region tank, and which agitates and conveys the developer in a direction toward the developer bearing member;

a second agitating and conveying member which is disposed so as to extend from the developing region tank to the agitating region tank, and which supplies the developer to the developer bearing member, and which also agitates and conveys the developer in a direction away from the developer bearing member, wherein the first agitating and conveying member and the second agitating and conveying member penetrate the partition wall member, and wherein the partition wall member partially blocks a developer conveying path of the first agitating and conveying member;

a third agitating and conveying member which is disposed between the first agitating and conveying member and the second agitating and conveying member in the agitating region tank, and which agitates and conveys the developer in a direction away from the developer bearing member; and an opening portion for discharging a predetermined amount of the developer from the developing tank.

2. The developing device of claim 1, wherein the partition wall member partially blocks a developer conveying path of the second agitating and conveying member.

3. The developing device of claim 1, wherein the opening portion is formed in a developing tank wall which is on a downstream side of the developer bearing member in an agitating and conveying direction of the developer by the second agitating and conveying member and faces the second agitating and conveying member.

4. The developing device of claim 1, wherein the opening portion is formed in a developing tank wall of the developing region tank which is on the downstream side of the developer bearing member in the agitating and conveying direction of the developer by the second agitating and conveying member and faces the second agitating and conveying member.

5. The developing device of claim 1, wherein the developing tank includes a sensor which is disposed on a developing tank wall and which detects an amount of the developer, the sensor facing the first agitating and conveying member.

6. The developing device of claim 5, wherein the sensor is a magnetic permeability sensor or a piezoelectric sensor.

7. The developing device of claim 1, wherein the developing tank further includes a developer replenishing port which is formed on a developing tank wall above the second agitating and conveying member and the third agitating and conveying member in the agitating region tank, and receives the mixture of toner and carrier to be replenished.

8. The developing device of claim 7, further comprising a toner hopper which is disposed so as to be in communication with the developer replenishing port, accepts the mixture of toner and carrier in an inner space thereof, and replenishes the mixture of toner and carrier to the agitating region tank through the developer replenishing port.

9. The developing device of claim 1, wherein the first agitating and conveying member, the second agitating and conveying member and the third agitating and conveying member are configured such that, for the same rate of rotation, they all convey substantially the same flow rate of developer.

10. The developing device of claim 1, wherein the first agitating and conveying member, the second agitating and conveying member and the third agitating and conveying member are configured such that, for the same rate of rotation, they all convey different flow rates of developer.

11. The developing device of claim 1, further comprising an intermediate wall member that is located in the agitating region tank between the first agitating and conveying member and the third agitating and conveying member.

12. The developing device of claim 11, wherein a length of the intermediate wall member is smaller than a length of the third agitating and conveying member, and wherein the intermediate wall member is located in the agitating region tank such that developer can move between the first and third agitating and conveying members around end edges of the intermediate wall member.

13. The developing device of claim 1, wherein a first portion of the developer that is being conveyed by the first agitating and conveying member within the agitating region tank passes into the developing region tank, and wherein a portion of the partition wall member that partially blocks a developer conveying path of the first agitating and conveying member causes a second portion of the developer being conveyed by the first agitating and conveying member within the agitating region tank to be diverted toward the third agitating and conveying member within the agitating region tank.

14. The developing device of claim 2, wherein a first portion of the developer that is being conveyed by the second agitating and conveying member within the developing region tank passes into the agitating region tank, and wherein a portion of the partition wall member that partially blocks a developer conveying path of the second agitating and conveying member causes a second portion of the developer being conveyed by the second agitating and conveying member within the developing region tank to be diverted toward the first agitating and conveying member within the developing region tank.

15. The developing device of claim 1, wherein a first side edge of the partition wall member partially blocks a developer conveying path of the first agitating and conveying member, the first side edge extending between conveying blades of the first agitating and conveying member.

16. The developing device of claim 15, wherein a second side edge of the partition wall member partially blocks a developer conveying path of the second agitating and conveying member, the second side edge extending between conveying blades of the second agitating and conveying member.

17. A developing device which is provided in an electrophotographic image forming apparatus to supply a developer to a photoreceptor provided in the image forming apparatus, comprising:

a developer bearing member disposed rotatably so as to face the photoreceptor;

a developing tank for housing the developer therein, a length of the developing tank extending beyond a length of the developer bearing member, the developing tank including:

a developing region tank which agitates and conveys the developer and supplies the developer to the developer bearing member, an agitating region tank which is disposed at one end of the developing region tank and at a position beyond the length of the developer bearing member, wherein the agitating tank region agitates and mixes toner and carrier supplied into the developing tank with the developer already present in the developing tank and supplies the mixture to the developing region tank, and a partition wall member which is disposed so as to separate the developing region tank from the agitating region tank;

a first agitating and conveying member which is disposed so as to extend from the agitating region tank to the developing region tank, and which agitates and conveys the developer in a direction passing from the agitating region tank into the developing region tank;

a second agitating and conveying member which is disposed so as to extend from the developing region tank to the agitating region tank, and which supplies the developer to the developer bearing member, and which also agitates and conveys the developer in a direction away from the developer bearing member;

a third agitating and conveying member which is disposed between the first agitating and conveying member and the second agitating and conveying member in the agitating region tank, and which agitates and conveys the developer in a direction away from the developer bearing member; and an intermediate wall member that is located in the agitating region tank between the first agitating and conveying member and the third agitating a conveying member, wherein a length of the intermediate wall member is smaller than a length of the third agitating and conveying member, and wherein the intermediate wall member is located in the agitating region tank such that developer can move around end edges of the intermediate wall member to pass between the first and third agitating and conveying members.

18. The developing device of claim 17, wherein a portion of the partition wall member partially blocks a developer conveying path of the first agitating and conveying member such that a portion of the developer being conveyed by the first agitating and conveying member within the agitating region tank is diverted around an end edge of the intermediate wall member toward the third agitating and conveying member.

19. The developing device of claim 18, wherein a first side edge of the partition wall member partially blocks the developer conveying path of the first agitating and conveying member, and wherein the first side edge extends between conveying blades of the first agitating and conveying member.

* * * * *